US010081185B2

(12) United States Patent
Kimura et al.

(10) Patent No.: US 10,081,185 B2
(45) Date of Patent: Sep. 25, 2018

(54) LIQUID EJECTION HEAD, LIQUID EJECTION APPARATUS, FLOW PATH MEMBER, AND METHOD FOR MANUFACTURING LIQUID EJECTION HEAD

(71) Applicant: CANON KABUSHIKI KAISHA, Tokyo (JP)

(72) Inventors: Satoshi Kimura, Kawasaki (JP); Yukuo Yamaguchi, Tokyo (JP); Mikiya Umeyama, Tokyo (JP); Yasushi Iijima, Tokyo (JP); Kyosuke Toda, Kawasaki (JP); Naoko Tsujiuchi, Kawasaki (JP); Hiromasa Amma, Kawasaki (JP); Takuya Iwano, Inagi (JP); Satoshi Oikawa, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/704,447

(22) Filed: Sep. 14, 2017

(65) Prior Publication Data

US 2018/0086064 A1 Mar. 29, 2018

(30) Foreign Application Priority Data

Sep. 23, 2016 (JP) ..... 2016-185600

(51) Int. Cl.
*B41J 2/04* (2006.01)
*B41J 2/05* (2006.01)
(Continued)

(52) U.S. Cl.
CPC ..... *B41J 2/1433* (2013.01); *B41J 2/162* (2013.01); *B41J 2/1637* (2013.01); *B41J 2002/14419* (2013.01)

(58) Field of Classification Search
CPC ..... B41J 2/1433; B41J 2/162; B41J 2/1637; B41J 2/1639; B29C 2045/0063; B29C 2045/1637
(Continued)

(56) References Cited

U.S. PATENT DOCUMENTS 5,969,738 A 10/1999 Tomikawa et al.
6,540,343 B1 4/2003 Umeyama et al.
(Continued)

FOREIGN PATENT DOCUMENTS

JP 09-183230 A 7/1997
JP 2007-296801 A 11/2007
(Continued)

OTHER PUBLICATIONS

Office Action dated Apr. 24, 2018, in Japanese Patent Application No. 2016-185600.

*Primary Examiner* — An Do
(74) *Attorney, Agent, or Firm* — Fitzpatrick, Cella, Harper & Scinto

(57) ABSTRACT

An opposed surface of a first flow path forming member has a groove portion forming a supply passage, and a protruding portion protruding from the edge of the groove portion to form the side wall of the groove portion. An opposed surface of a second flow path forming member has a lid portion that abuts against the protruding portion of the first flow path forming member to cover the opening of the groove portion in the first flow path forming member. A joining member is formed by injection-molding of a resin to abut against an outer surface of the protruding portion of the first flow path forming member and the opposed surfaces of the first and second flow path forming members.

16 Claims, 7 Drawing Sheets

(51) Int. Cl.
*B41J 2/14* (2006.01)
*B41J 2/16* (2006.01)

(58) Field of Classification Search
USPC ..... 347/54, 63, 65
See application file for complete search history.

(56) References Cited

U.S. PATENT DOCUMENTS

| | | | | |
|---|---|---|---|---|
| 6,554,394 | B1 | 4/2003 | Yamaguchi et al. | |
| 6,799,841 | B2 | 10/2004 | Iri et al. | |
| 8,388,114 | B2 | 3/2013 | Yamaguchi et al. | |
| 8,727,503 | B2 | 5/2014 | Yamaguchi et al. | |
| 8,998,375 | B2 | 4/2015 | Amma et al. | |
| 9,102,151 | B2 * | 8/2015 | Minami | B41J 2/1642 |
| 9,370,928 | B2 | 6/2016 | Toda et al. | |
| 9,475,288 | B2 | 10/2016 | Kudo et al. | |
| 9,770,911 | B2 | 9/2017 | Inada et al. | |
| 2016/0339711 | A1 | 11/2016 | Muraoka et al. | |

FOREIGN PATENT DOCUMENTS

| | | | |
|---|---|---|---|
| JP | 2012-223886 | A | 11/2012 |
| JP | 5435962 | B2 | 3/2014 |

* cited by examiner

LIQUID EJECTION HEAD, LIQUID EJECTION APPARATUS, FLOW PATH MEMBER, AND METHOD FOR MANUFACTURING LIQUID EJECTION HEAD

BACKGROUND OF THE INVENTION

Field of the Invention

The present invention relates to a liquid ejection head capable of ejecting liquid such as ink, a liquid ejection apparatus using the liquid ejection head, a flow path member, and a method for manufacturing the liquid ejection head.

Description of the Related Art

Japanese Patent No. 5435962 discloses a liquid ejection head which includes a liquid supply unit having a supply passage of liquid formed therein, and a liquid ejection unit capable of ejecting the liquid supplied through the supply passage from an ejection port. The liquid supply unit has a configuration in which a first flow path forming member and a second flow path forming member are joined by a joining member of a resin. In manufacturing the liquid supply unit, first, at different positions between a fixed mold and a movable mold, the first flow path forming member having a groove portion and the second flow path forming member having a lid portion are molded at the same time (primary molding). Thereafter, the molds are opened, while holding the first flow path forming member in the movable mold and holding the second flow path forming member in the fixed mold. Thereafter, the movable mold is relatively moved so that the flow path forming members face each other, and then, the molds are closed. Thus, the opening portion of the groove portion of the first flow path forming member and the lid portion of the second flow path forming member are brought into contact with each other, and a supply passage of liquid is formed. In this state, by injecting the molten resin into a space formed by the outer peripheral surface of the lid portion, the surface of the first flow path forming member, and the inner surface of the fixed mold to form a joining member, the first and second flow path forming members are integrated (secondary molding). The joining member is formed to cover the outer peripheral portion of the lid portion.

Since such a liquid supply unit is merely formed so that the joining member covers the periphery of the lid portion, the joining surface between the joining member and the first and second flow path forming members is small, and it is difficult to enhance the joining strength of the first flow path forming member and the second flow path forming member.

SUMMARY OF THE INVENTION

The invention attains miniaturization of the liquid supply unit and further miniaturization of the liquid ejection head, while enhancing the joining strength of the first and second flow path forming members in the liquid supply unit.

In the first aspect of the present invention, there is provided a liquid ejection head comprising a liquid supply unit having a supply passage of liquid formed therein; and a liquid ejection unit capable of ejecting the liquid supplied through the supply passage from an ejection port, wherein the liquid supply unit includes first and second flow path forming members having first and second opposed surfaces opposed to each other, and a joining member which joins the first and second flow path forming members, the first opposed surface has a groove portion which forms the supply passage, and a protruding portion protruding from the first opposed surface to form a side wall of the groove portion, the second opposed surface has a lid portion which abuts against the protruding portion to cover the opening of the groove portion, and the joining member is formed of a resin to come into contact with an outer surface of the protruding portion, the first opposed surface, and the second opposed surface.

In the second aspect of the present invention, there is provided a liquid ejection apparatus comprising a supply portion of liquid; a liquid ejection head capable of ejecting the liquid, which is supplied from the supply portion, from an ejection port using an ejection energy generation element; and a control unit which controls the ejection energy generation element, wherein the liquid ejection head comprises a liquid supply unit having a supply passage of the liquid formed therein, and a liquid ejection unit capable of ejecting the liquid supplied through the supply passage from the ejection port, the liquid supply unit includes first and second flow path forming members having first and second opposed surfaces opposed to each other, and a joining member which joins the first and second flow path forming members, the first opposed surface has a groove portion which forms the supply passage, and a protruding portion protruding from the first opposed surface to form a side wall of the groove portion, the second opposed surface has a lid portion which abuts against the protruding portion to cover the opening of the groove portion, and the joining member is formed of a resin to come into contact with an outer surface of the protruding portion, the first opposed surface, and the second opposed surface.

In the third aspect of the present invention, there is provided a flow path member having a supply passage for supplying liquid to a liquid ejection head which ejects the liquid, the flow path member comprising:

first and second flow path forming members having first and second opposed surfaces opposed to each other, and a joining member which joins the first and second flow path forming members, wherein the first opposed surface has a groove portion which forms the supply passage, and a protruding portion protruding from the first opposed surface to form a side wall of the groove portion, the second opposed surface has a lid portion which abuts against the protruding portion to cover the opening of the groove portion, and the joining member is formed of a resin to come into contact with an outer surface of the protruding portion, the first opposed surface, and the second opposed surface.

In the fourth aspect of the present invention, there is provided a method for manufacturing a liquid ejection head comprising a liquid supply unit having a supply passage of liquid formed therein, and a liquid ejection unit capable of ejecting the liquid supplied through the supply passage from an ejection port, the liquid supply unit including first and second flow path forming members having first and second opposed surfaces opposed to each other, and a joining member which joins the first and second flow path forming members, the method comprising the steps of:

injection-molding the first flow path forming member having a groove portion forming the supply passage, and a protruding portion protruding from the first opposed surface to form a side wall of the groove portion, on the first opposed surface, at a first position between first and second molds, and injection-molding the second flow path forming member having a lid portion abutting against the protruding portion to cover the opening of the groove portion on the second opposed surface, at a second position between the first and second molds;

opening the first and second molds, while holding the first flow path forming member in the first mold and holding the second flow path forming member in the second mold;

relatively moving the first and second molds so that the protruding portion of the first flow path forming member and the lid portion of the second flow path forming member are made to face each other;

closing the first and second molds so that the protruding portion and the lid portion are made to abut against each other; and injection-molding the joining member which abuts against an outer surface of the protruding portion, the first opposed surface, and the second opposed surface.

According to the invention, by shifting the opening position of the groove portion by the protruding portion, the supply passage of liquid and the joining member can be efficiently deployed, while increasing the joining surface between the joining member and the first and second flow path forming members. As a result, it is possible to reduce the sizes of the liquid supply unit and the flow path member, and further reduce the size of the liquid ejection head or the like including the same, while enhancing the joining strength of the first and second flow path forming members.

Further features of the present invention will become apparent from the following description of exemplary embodiments with reference to the attached drawings.

DESCRIPTION OF THE EMBODIMENTS

Hereinafter, embodiments of the invention will be described with reference to the drawings.

Figure 1A:
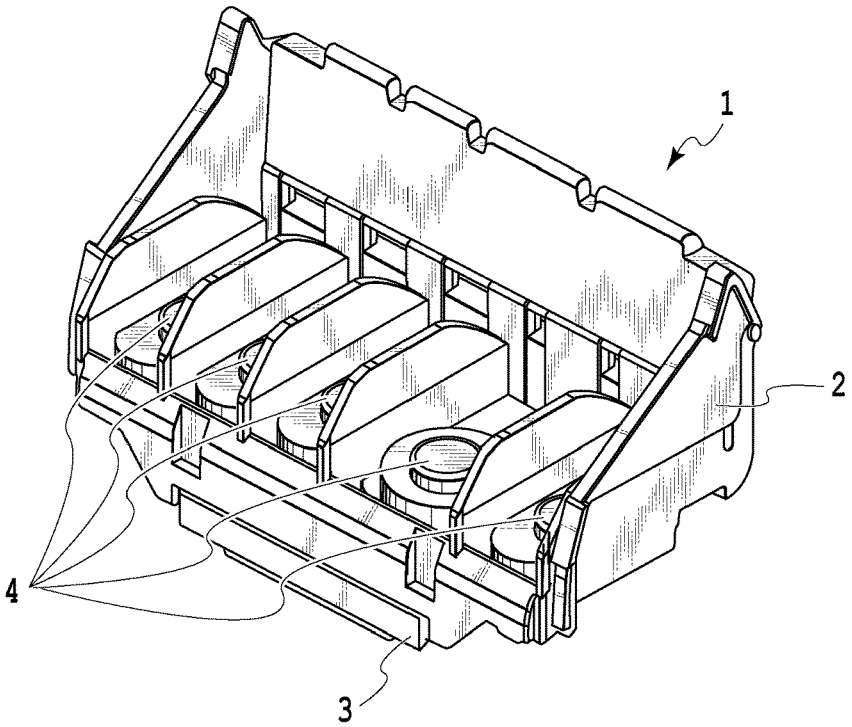
FIGS. 1A and 1B are perspective views for describing a configuration example of a liquid ejection head of the invention, respectively.
Figure 1B:
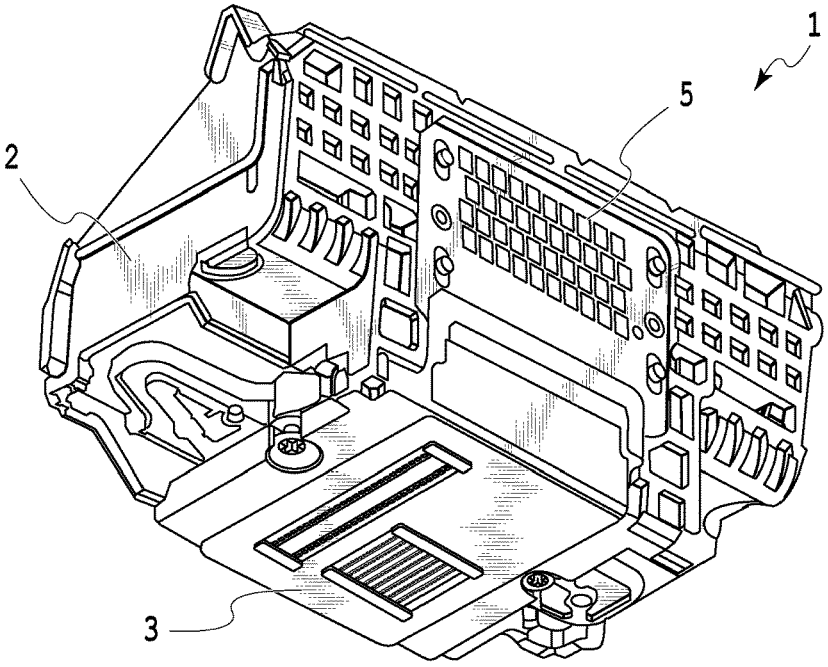

FIGS. 1A and 1B are perspective views of a liquid ejection head 1 according to an embodiment of the invention as seen from different directions. The liquid ejection head 1 of this example has a liquid supply unit (casing) 2, a liquid ejection unit 3, and an electrical connection substrate 5. The supply unit 2 is provided with a connecting portion 4 to be connected to a liquid storage container (not illustrated). The liquid in the storage container is supplied to the ejection unit 3 through the connecting portion 4 and a supply passage of liquid provided in the supply unit 2. The ejection unit 3 includes a plurality of ejection ports capable of ejecting the supplied liquid, and a plurality of ejection energy generation elements which generates ejection energy for ejecting liquid from each ejection port. As the ejection energy generation element, an electrothermal conversion element (heater), a piezo element or the like can be used. These ejection energy generation elements are driven in accordance with input signals from the electrical connection substrate 5 to eject liquid from the corresponding ejection ports.

The liquid ejection head 1 can be configured to eject various kinds of liquid. For example, the liquid ejection head 1 can be configured as an inkjet printing head capable of ejecting ink. In this case, ink in the ink tank (storage container) (not illustrated) is supplied to the ejection unit 3 through the connecting portion 4 and the supply passages in the supply unit 2, and when driving the ejection energy generation element, ink is ejected from the corresponding ejection port.

Figure 2:
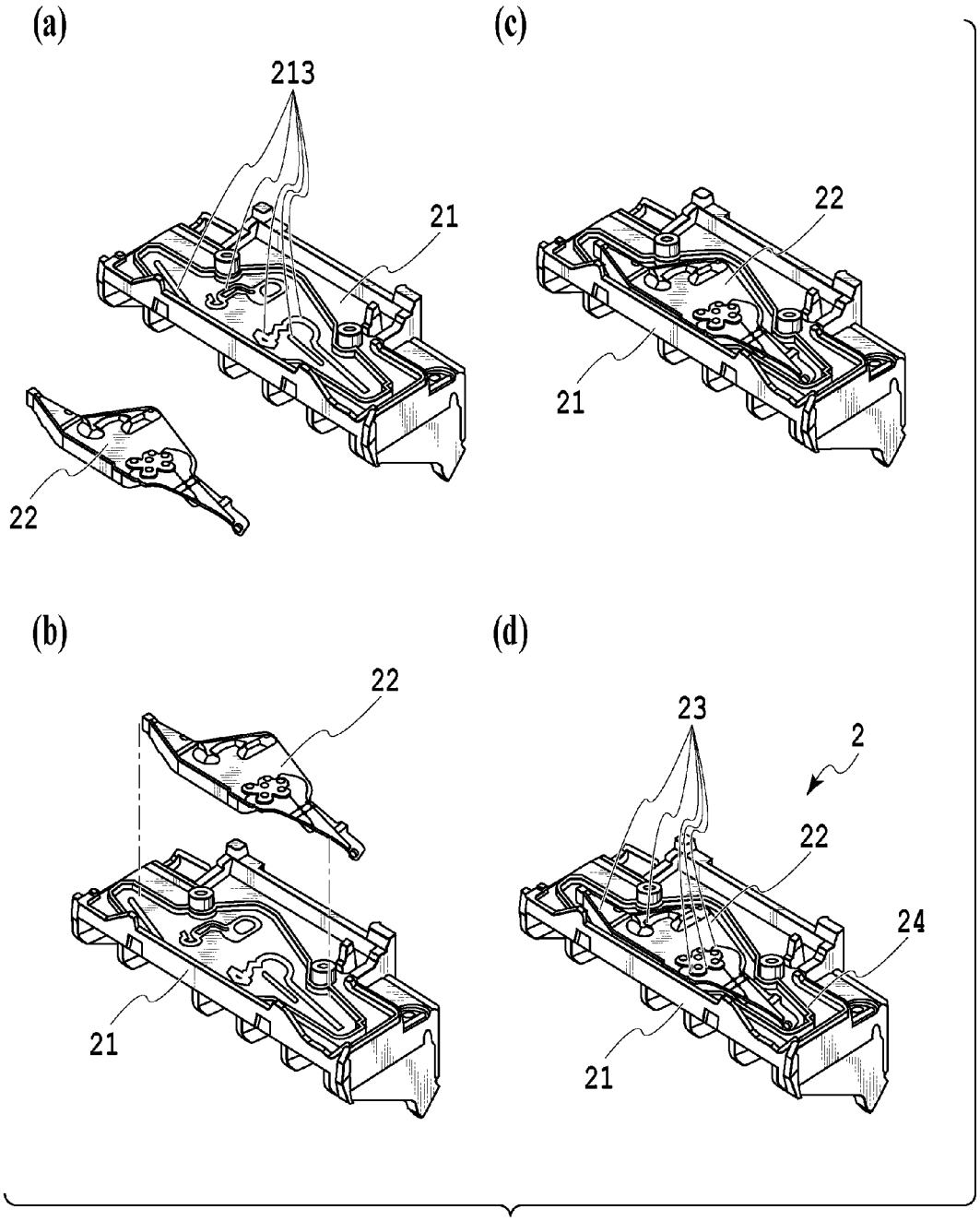
FIG. 2 is a perspective view for describing a manufacturing process of the liquid supply unit of FIG. 1A.
Figure 3:
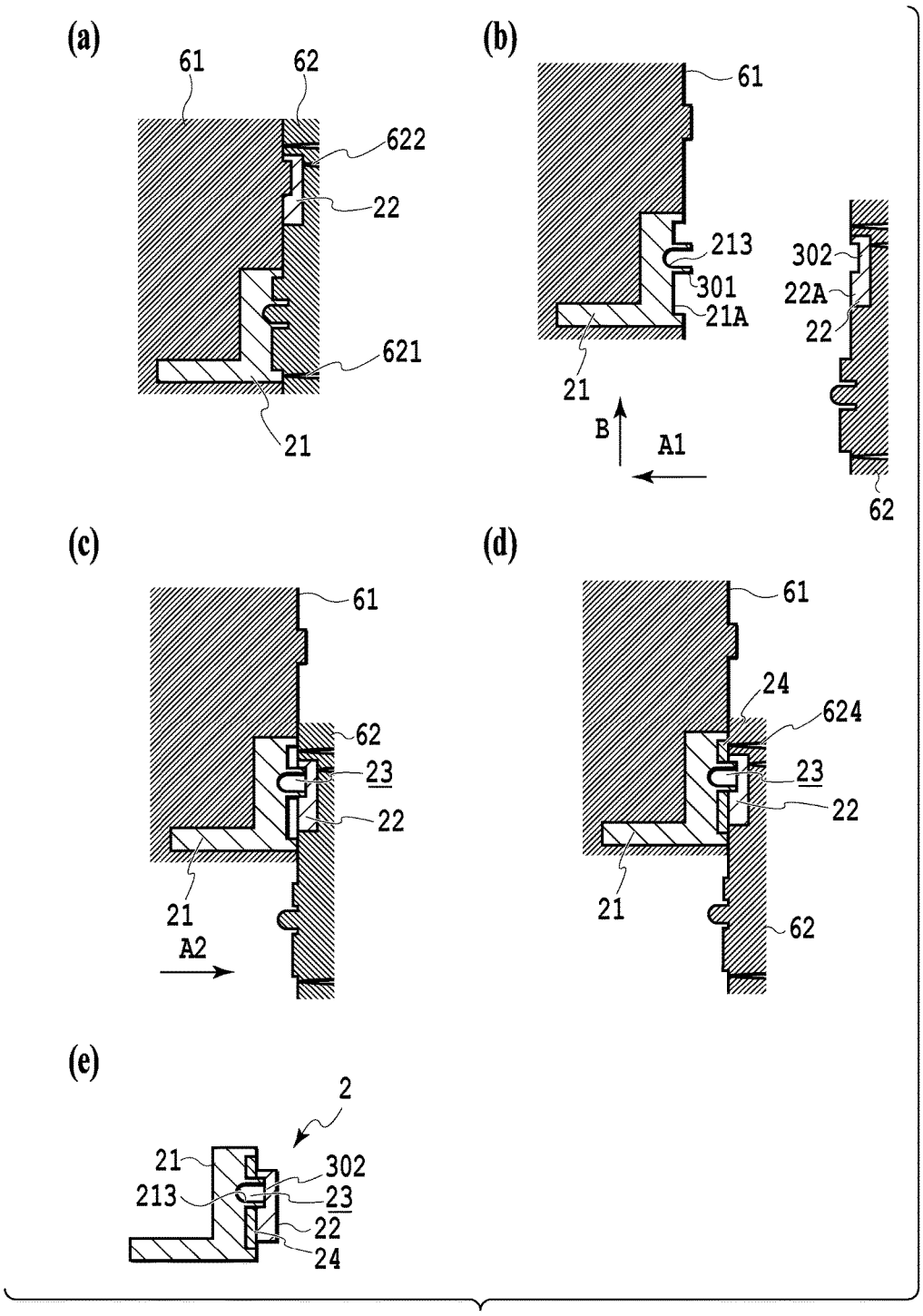
FIG. 3 is a cross-sectional view for describing the manufacturing process of the liquid supply unit of FIG. 1A.
Figure 4:
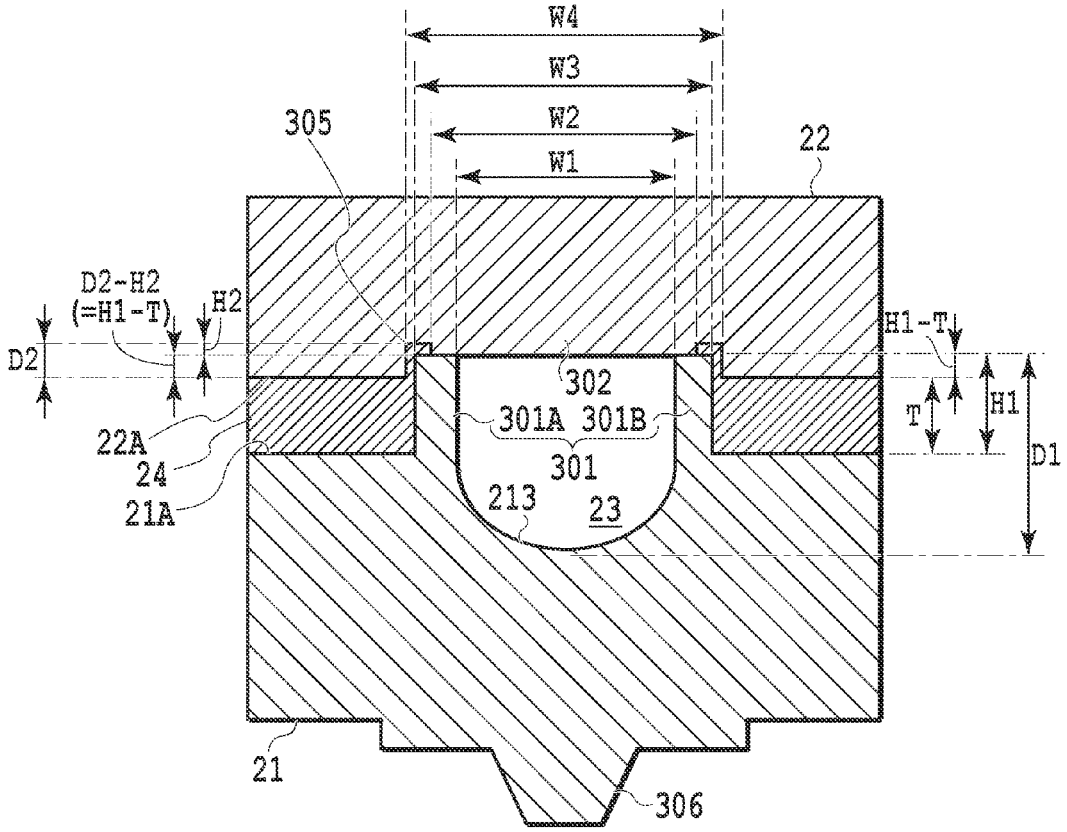
FIG. 4 is an enlarged cross-sectional view of a main part of the liquid supply unit of FIG. 1A.

Parts (a) to (d) of FIG. 2 are explanatory views of some parts (first to fourth processes) of the manufacturing process of the supply unit 2. Parts (a) to (d) of FIG. 3 are schematic cross-sectional views of the supply unit 2 and the mold in the first to fourth processes of the parts (a) to (d) of FIG. 2, respectively. Further, a part (e) of FIG. 3 is a schematic cross-sectional view of the supply unit 2 extracted from the mold after the fourth process. FIG. 4 is a schematic cross-sectional view of a supply passage of liquid in the supply unit 2.

The supply unit 2 is formed by injection molding of a resin. In the first process, as illustrated in the part (a) of FIG. 3, at the different positions inside first and second molds 61 and 62, a first flow path forming member 21 and a second flow path forming member 22 constituting the supply unit 2 are individually injection-molded. That is, the first flow path forming member 21 is injection-molded at a first position between the molds 61 and 62, and the second flow path forming member 22 is injection-molded at a second position between the molds 61 and 62. Resins that form the flow path forming members 21 and 22 are supplied from gates 621 and 622 provided in the second mold 62, respectively. The molds 61 and 62 can be relatively moved (die-slid). In this example, the first mold 61 moves with respect to the second mold 62. In this example, the resins forming the flow path forming members 21 and 22 are the same filler-containing resin.

In order to form a supply passage of liquid in the supply unit 2, a groove portion is provided in one of the opposed surfaces of the flow path forming members 21 and 22, and a lid portion for covering the opening of the groove portion is provided on the other thereof. In this example, in order to form a supply passage 23 of liquid in the supply unit 2, a groove portion 213 is provided on a first opposed surface 21A on the first flow path forming member 21 side, and a lid portion 302 that covers the opening of the groove portion 213 is provided on a second opposed surface 22A on the second flow path forming member side. The opposed surface 22A is provided with a protruding portion 301 that protrudes from the edge of the groove portion 213 to form a side portion of the groove portion 213. The detailed shapes of the groove portion 213 and the lid portion 302 will be described later.

In the second process, as illustrated in the part (b) of FIG. 3, after the mold 61 is moved in a direction of the arrow A1 to open the molds 61 and 62, the mold 61 is moved (die-slid) in a direction of arrow B. The first flow path forming member 21 is held by the mold 61, the second flow path forming member 22 is held by the mold 62, and the mold 61 moves in the direction of the arrow B to cause these flow path forming members 22 and 21 to face each other. After the movement of the mold 61, as illustrated in the part (b) of FIG. 3, the groove portion 213 of the first flow path forming member 21 and the lid portion 302 of the second flow path forming member 22 face each other.

In the next third process, by moving the mold 61 in a direction of arrow A2 and closing the molds 61 and 62 again, as illustrated in the part (c) of FIG. 3, the protruding portion 301 of the groove portion 213 and the lid portion 302 are made to abut against each other. Thus, the opening of the groove portion 213 is covered with the lid portion 302, and the supply passage 23 is formed.

In the next fourth process, molten resin is poured between the flow path forming members 21 and 22 located outside the supply passage 23 to perform injection-molding of a joining member 24. The resin forming the joining member 24 is supplied through a gate 624 provided in the mold 62.

The joining member 24 is formed to abut against the outer surface of the protruding portion 301, the first opposed surface 21A, and the second opposed surface 22A. Therefore, it is possible to enhance the joining strength by increasing the joining surface between the joining member 24 and the first and second flow path forming members 21 and 22. Further, due to compatibilization of resin, the first flow path forming member 21 and the joining member 24 are joined together, and the second flow path forming member 22 and the joining member 24 are joined together, and thus these are integrated. In the case of this example, the resin forming the joining member 24 is the same as the resins forming the flow path forming members 21 and 22. The forming material of the joining member 24 may be a material that is compatible with the forming materials of the flow path forming members 21 and 22, and may be different from the forming materials of the flow path forming members 21 and 22.

As illustrated in FIG. 4, the protruding portions 301 (first and second protruding portions 301A and 301B) are provided on both left and right side edges of the groove portion 213 in FIG. 4. The first protruding portion 301A is located on one side of both side edges of the groove portion 213, and the second protruding portion 301B is located on the other side of both side edges of the groove portion 213. The protruding portions 301A and 301B protrude upward in FIG. 4 from the edges of the groove portion 213, and extend along the length direction of the groove portion 213, thereby forming opening edge portions (side walls) of the groove portion 213. The protruding portion 301 may be provided on only one of both side edges of the groove portion 213. A protrusion height H1 of the protruding portion 301 is larger than a thickness T of the joining member 24. Meanwhile, the lid portion 302 of the second flow path forming member 22 is provided to protrude downward in FIG. 4 from the interior of a recessed portion 305. A depth D2 of the recessed portion 305 is larger than a protrusion height H2 of the lid portion 302. Therefore, the lid portion 302 is located at a position lower than the second opposed surface 22A by (D2−H2), that is, on the bottom surface side of the recessed portion 305. The lid portion 302 extends along the length direction of the groove portion 213. A width W2 of the lid portion 302 is smaller than a width W4 of the recessed portion 305, is larger than a distance (the width of the groove portion 213) W1 between the inner surfaces of the protruding portions 301A and 301B, and is smaller than a distance W3 between the outer surfaces of the protruding portions 301A and 301B. The lid portion 302 abuts against the upper ends of the protruding portions 301A and 301B to close the opening of the groove portion 213, thereby forming the supply passage 23 having the depth D1.

Figure 5A:
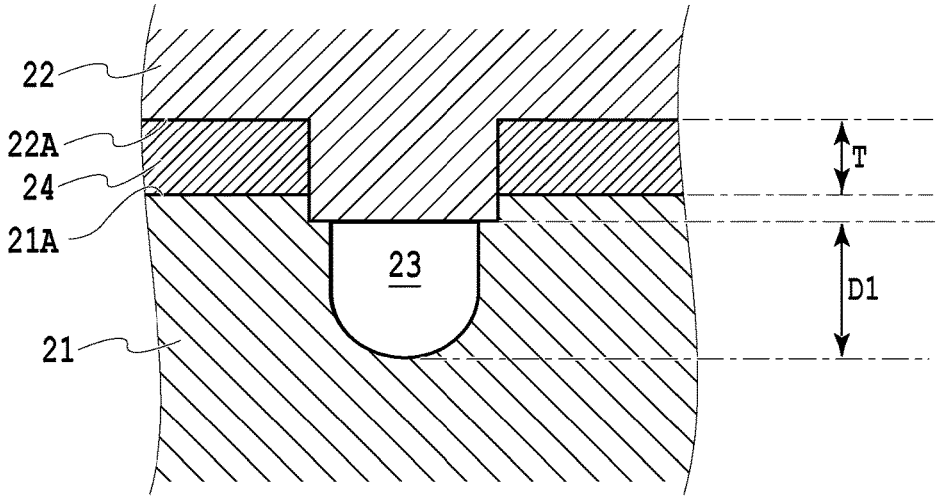
FIGS. 5A and 5B are explanatory views of a supply passage as a comparative example, respectively.

The opening of the groove portion 213 is shifted upward in FIG. 4 by the height H1 of the protruding portion 301. Therefore, in the up-down direction in FIG. 4, the range of the supply passage 23 in the direction of the depth D1 and the range of the joining member 24 in the direction of the thickness T overlap each other. In the example of FIG. 4, the latter range is included within the former range. By making these ranges overlap each other in this manner, it is possible to ensure the formation position of the joining member 24 of the thickness T within the range of the supply passage 23 in the direction of the depth D1, and as a result, it is possible to reduce the sizes of the supply unit 2 and the liquid ejection head. At least some parts of the range of the depth D1 and the range of the thickness T may overlap each other. In this case, the same effect can also be obtained. As in a comparative example of FIG. 5A, when the protruding portion 301 is not provided, the range of the supply passage 23 in the direction of depth D1 and the range of the joining member 24 in the direction of thickness T do not overlap each other. Therefore, in the up-down direction in FIG. 5A, these ranges need to be secured separately, which leads to increase in sizes of the supply unit and the liquid ejection head.

Further, since the depth D2 of the recessed portion 305 is larger than the protrusion height H2 of the lid portion 302, the abutment position between the lid portion 302 and the protruding portion 301 deviates toward the interior of the recessed portion by D2−H2 (=H1−T). Thus, a fitting portion of the flow path forming members 21 and 22 can be secured on the second flow path forming member 22 side. In the case of the comparative example of FIG. 5A, since the fitting portion of the flow path forming members 21 and 22 is located on the first flow path forming member 21 side (the supply passage 23 side), it is necessary to form the supply passage 23 of the depth D1 at a position deeper from the first opposed surface 21A, accordingly.

Further, since the width W2 of the lid portion 302 is smaller than the distance W3 between the outer surfaces of the protruding portions 301A and 301B, by reducing the width ((W2−W1)/2) of the lid portion 302 abutting against the protruding portion 301, the contact area between the protruding portion 301 and the lid portion 302 can be reduced. This is effective in enhancing the surface precision of the contact surfaces and securing adhesion of high-precision and high sealing performance.

In the case of this example, in the use state of the liquid ejection head, the first flow path forming member 21 is located on the lower side, and the second flow path forming member 22 is located on the upper side. Therefore, the ejection unit 3 communicating with the supply passage 23 is connected to the lower portion of the first flow path forming member 21 in FIG. 4 via an elastic member (not illustrated). Specifically, a connecting portion 306 is formed in the lower portion of the first flow path forming member 21 corresponding to the bottom of the groove portion 213, and the ejection unit 3 is connected to the connecting portion 306 via a seal member such as an O-ring. When the shape of the connecting portion 306 has a protruding portion protruding downward as illustrated in FIG. 4, by forming the connecting portion 306 on the lower side of the groove portion 213, the thickness of the first flow path forming member 21 in the lower portion of the groove portion 213 can be suppressed within a predetermined range. This is effective in making the thickness of the first flow path forming member 21 uniform to suppress the deformation of the first flow path forming member 21 due to sink, warpage and the like peculiar to resin molding. In addition, various functional shape portions other than the connecting portion 306 can be added to the lower portion of the groove portion 213, while suppressing the deformation of the first flow path forming member 21, and the degree of design freedom can be enhanced.

Figure 6A:
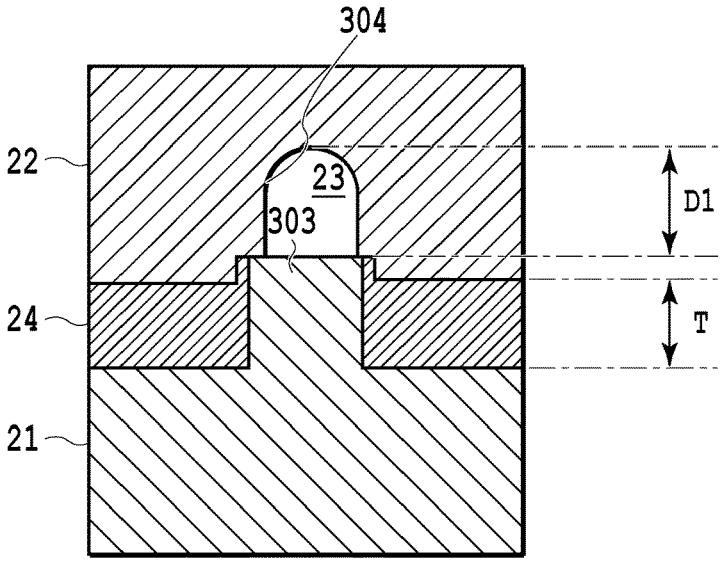
FIGS. 6A and 6B are explanatory views of a supply passage as a reference example, respectively.
Figure 6B:
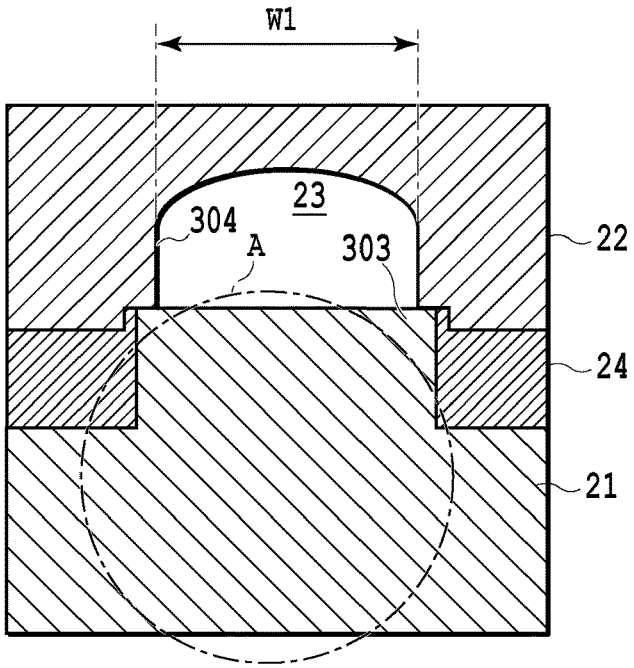

FIGS. 6A and 6B are explanatory views of the supply passage 23 as a reference example. In the reference example of FIG. 6A, contrary to the above-described embodiment of the invention, a groove portion 304 forming the supply passage 23 is provided in the second flow path forming member 22, and a convex lid portion 303 is provided in the first flow path forming member 21. As in the comparative example of FIG. 5A, since the protruding portion 301 is not provided, the range of the depth D1 of the supply passage 23 and the range of the thickness T of the joining member 24 do not overlap each other. If the width W1 of the supply passage 23 increases as illustrated in FIG. 6B, sink, warpage, or the like may occur in a region A (thick portion). As a countermeasure therefor, it is necessary to provide a recess portion in the region A, which may impair the degree of design freedom. Further, when the connecting portion 306 protruding downward as illustrated in FIG. 4 is provided in the region A, the wall thickness of the region A becomes larger, and sink, warpage or the like is more likely to occur.

Figure 5B:
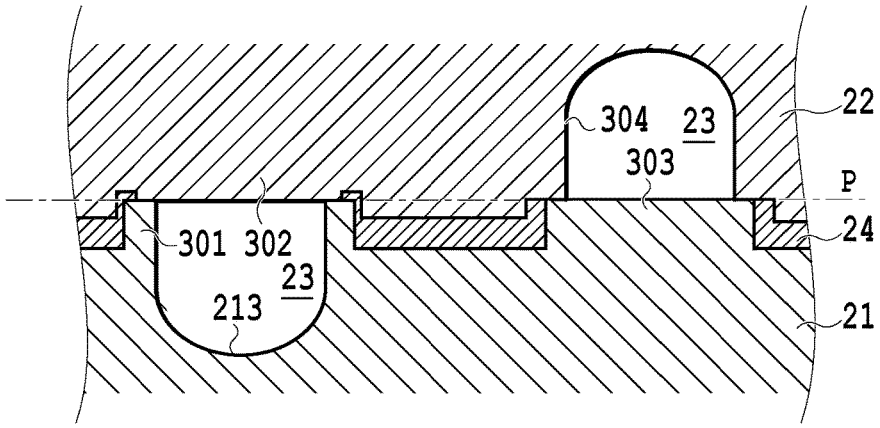

When a plurality of supply passages 23 is formed between the flow path forming members 21 and 22, at least one of these supply passages 23 may be configured as illustrated in FIG. 4. For example, as illustrated in FIG. 5B, the supply passage 23 as illustrated in FIG. 4 located on the left side in the drawing and the supply passage 23 as illustrated in FIG. 6A located on the right side in the same drawing may be formed to be mixed with each other. In this case, as illustrated in FIG. 5B, it is preferable that the abutment surfaces between the flow path forming members 21 and 22 in the left and right supply passages 23 in FIG. 5B be located on the same plane P. The abutment surface between the flow path forming members 21 and 22 in the supply passage 23 on the left side in FIG. 5B is an abutment surface between the protruding portion 301 and the lid portion 302. Meanwhile, the abutment surface between the flow path forming members 21 and 22 in the supply passage 23 on the right side in FIG. 5B is an abutment surface between the lid portion (first opposed surface side lid portion) 303 and an opening edge of the groove portion (second opposed surface side groove portion) 304. When the molten resin forming the joining member 24 is poured around the abutment surface between the flow path forming members 21 and 22, it is necessary to cause the flow path forming members 21 and 22 to reliably abut against each other so that the molten resin does not flow into the supply passage 23. In order to cause the flow path forming members 21 and to reliably abut against each other and to mold the supply unit 2 having the plurality of supply passages 23 with high accuracy, as illustrated in FIG. 5B, it is desirable to position the abutment surfaces between the flow path forming members 21 and 22 corresponding to the plurality of supply passages 23 on the same plane.

Further, in the liquid ejection head 1, in order to improve the stability of the ejection of the liquid supplied through the supply unit 2, in some cases, a storage portion of gas may be provided in the middle of the supply passage 23 to suppress the vibration of the liquid. In order to suppress vibration of the liquid, it is desirable that the volume of the upper part of the supply passage 23 having such a storage portion of gas be large. Therefore, it is necessary to form supply passages 23 having different sectional shapes. Since the volume of the upper part of the supply passage 23 on the left side in FIG. 5B is large, the supply passage 23 is effective as the supply passage 23 having the storage portion of gas for suppressing the vibration of liquid. Meanwhile, since the cross-sectional shape of the upper part of the supply passage 23 on the right side in FIG. 5B is substantially circular, the supply passage 23 is effective in collecting and discharging air bubbles in the supply passage 23. The supply passages on the left side and the right side in FIG. 5B may form different supply passages or may form a series of supply passages.

Figure 7A:
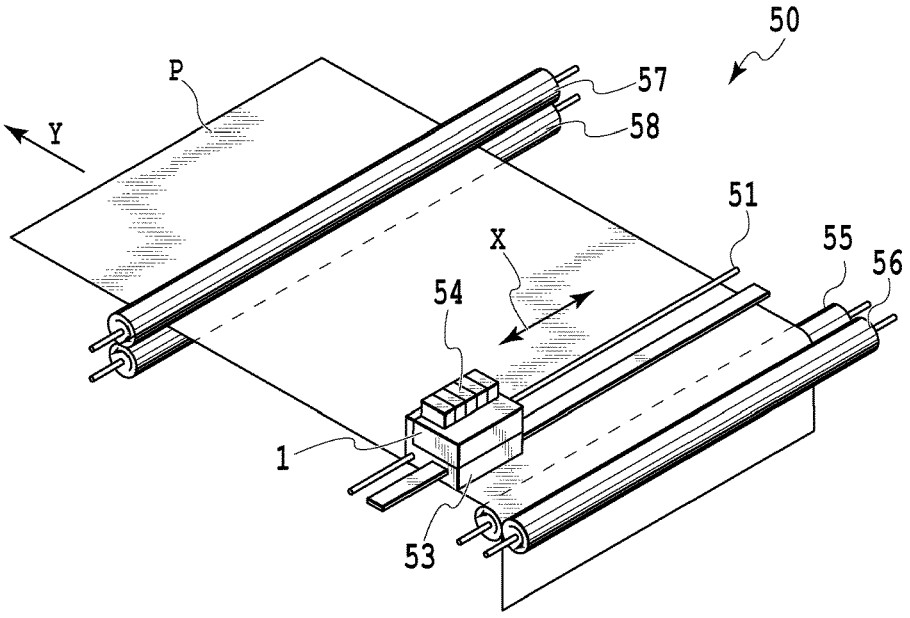
FIGS. 7A and 7B are explanatory views of a configuration example of a liquid ejection apparatus of the invention, respectively.
Figure 7B:
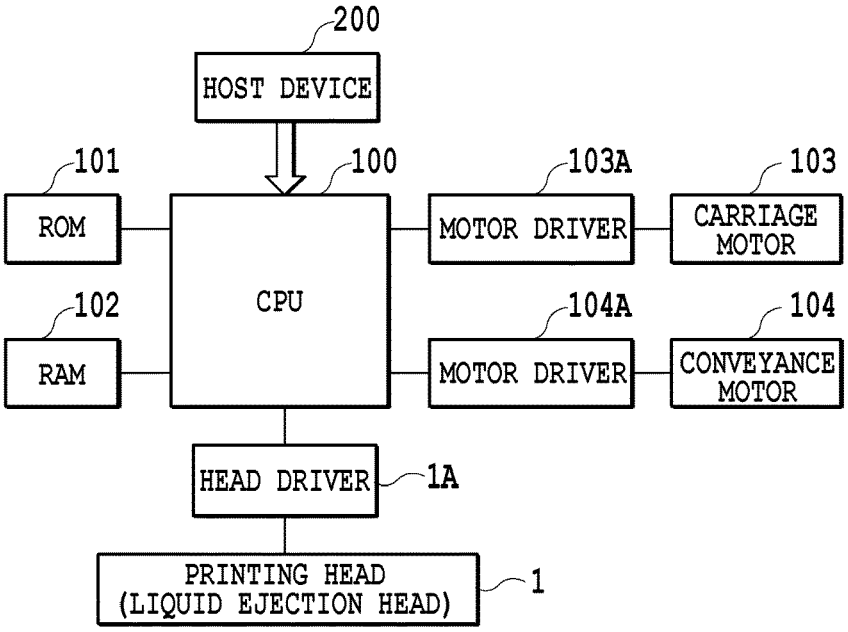

FIG. 7A is a schematic perspective view of a configuration example of a liquid ejection apparatus using the liquid ejection head 1, and FIG. 7B is a block diagram of a control system of the liquid ejection apparatus. The liquid ejection apparatus of this example is a serial scanning type inkjet printing apparatus 50 that ejects ink from the liquid ejection head 1 to print an image on a printing medium P. The liquid ejection head 1 as an inkjet printing head is mounted on a carriage 53, and the carriage 53 moves in a main scanning direction of an arrow X along a guide shaft 51. The printing medium P is conveyed by conveying rollers 55, 56, 57, and 58 in a sub-scanning direction of an arrow Y intersecting with (in this example, orthogonal to) the main scanning direction. An ink tank (supply unit) 54 connected to the connecting portion 4 of FIG. 1A is mounted on the printing head 1, and ink (liquid) in the ink tank 54 is supplied to the ejection unit 3 through the supply passage 23 of the supply unit 2. The ejection energy generation elements provided in the ejection unit 3 are driven by a head driver 1A in accordance with an input signal from the electrical connection substrate 5 of FIG. 1B.

A CPU (control unit) 100 controls the printing apparatus 50 based on a program such as a processing procedure stored in a ROM 101, and a RAM 102 is used as a work area or the like for executing those processes. The CPU 100 controls the head driver 1A based on the image data from a host device 200 outside the printing apparatus 50. Further, the CPU 100 controls a carriage motor 103 for moving the carriage 53 via a motor driver 103A, and controls a conveyance motor 104 for conveying the printing medium P via a motor driver 104A.

Other Embodiments

The invention can be widely applied to a liquid ejection head for ejecting various liquids, and a liquid ejection apparatus for ejecting various kinds of liquid. The invention can also be applied to a liquid ejection apparatus that performs various processes (printing, processing, coating, etc.) on various media, using a liquid ejecting head. The medium (including a printing medium) includes various media to which the liquid ejected from the liquid ejection head is applied, irrespective of materials such as paper, plastic, film, woven fabric, metal, and flexible substrate.

Further, the invention can be applied not only to the above-described liquid ejection head but also to a flow path member for supplying liquid to the liquid ejection head. The flow path member may be provided in the liquid ejection head, and is also applicable to a flow path member mounted on a printing apparatus main body as illustrated in FIG. 7A. For example, it is applicable to a flow path member of the ink tank 54 or a flow path member for supplying liquid from the ink tank 54 to the liquid ejection head 1.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-185600 filed Sep. 23, 2016, which is hereby incorporated by reference herein in its entirety.

What is claimed is:

1. A liquid ejection head comprising: a liquid supply unit having a supply passage for liquid formed therein; and a liquid ejection unit capable of ejecting the liquid supplied through the supply passage from an ejection port, wherein the liquid supply unit includes first and second flow path forming members having first and second opposed surfaces opposed to each other, and a joining member which joins the first and second flow path forming members, the first opposed surface has a groove portion which forms the supply passage, and a protruding portion protruding from the first opposed surface to form a side wall of the groove portion, the second opposed surface has a lid portion which abuts against the protruding portion to cover the opening of the groove portion, and the joining member is formed of a resin to come into contact with an outer surface of the protruding portion, the first opposed surface, and the second opposed surface.

2. The liquid ejection head according to claim 1, wherein at least some parts of a range of the groove portion in a depth direction and a range of the joining member in a thickness direction overlap each other in a direction in which the protruding portion protrudes.

3. The liquid ejection head according to claim 1, wherein the lid portion is located in a recessed portion formed in the second opposed surface.

4. The liquid ejection head according to claim 3, wherein the lid portion is located closer to the bottom surface side of the recessed portion than the second opposed surface.

5. The liquid ejection head according to claim 1, wherein the protruding portion includes a first protruding portion located on one side of both side edges of the groove portion, and a second protruding portion located on the other side.

6. The liquid ejection head according to claim 5, wherein a width of the lid portion is longer than a distance between inner surfaces of the first and second protruding portions, and is shorter than a distance between outer surfaces of the first and second protruding portions.

7. The liquid ejection head according to claim 5, wherein the lid portion is located in a recessed portion formed on the second opposed surface, and the width of the recessed portion is longer than the distance between the outer surfaces of the first and second protruding portions.

8. The liquid ejection head according to claim 1, wherein the first flow path forming member has a connecting portion for connecting the supply passage to the liquid ejection unit, at a position corresponding to the bottom of the groove portion, when viewed from a direction orthogonal to the first opposed surface.

9. The liquid ejection head according to claim 1, wherein a plurality of supply passages is formed in the liquid supply unit, and at least one of the plurality of supply passages is formed by a second opposed surface side groove portion provided on the second opposed surface, and a first opposed surface side lid portion provided on the first opposed surface formed to cover the opening of the second opposed surface side groove portion.

10. The liquid ejection head according to claim 9, wherein an abutment position between the protruding portion of the first opposed surface and the lid portion of the second opposed surface and an abutment position between the opening of the second opposed surface side groove portion and the first opposed surface side lid portion are located on the same plane.

11. A liquid ejection apparatus comprising: a supply portion for liquid; a liquid ejection head capable of ejecting the liquid, which is supplied from the supply portion, from an ejection port using an ejection energy generation element; and a control unit which controls the ejection energy generation element, wherein the liquid ejection head comprises a liquid supply unit having a supply passage of the liquid formed therein, and a liquid ejection unit capable of ejecting the liquid supplied through the supply passage from the ejection port, the liquid supply unit includes first and second flow path forming members having first and second opposed surfaces opposed to each other, and a joining member which joins the first and second flow path forming members, the first opposed surface has a groove portion which forms the supply passage, and a protruding portion protruding from the first opposed surface to form a side wall of the groove portion, the second opposed surface has a lid portion which abuts against the protruding portion to cover the opening of the groove portion, and the joining member is formed of a resin to come into contact with an outer surface of the protruding portion, the first opposed surface, and the second opposed surface.

12. A flow path member having a supply passage for supplying liquid to a liquid ejection head which ejects the liquid, the flow path member comprising:

first and second flow path forming members having first and second opposed surfaces opposed to each other, and a joining member which joins the first and second flow path forming members, wherein the first opposed surface has a groove portion which forms the supply passage, and a protruding portion protruding from the first opposed surface to form a side wall of the groove portion, the second opposed surface has a lid portion which abuts against the protruding portion to cover the opening of the groove portion, and the joining member is formed of a resin to come into contact with an outer surface of the protruding portion, the first opposed surface, and the second opposed surface.

13. The flow path member according to claim 12, wherein at least some parts of a range of the groove portion in a depth direction and a range of the joining member in a thickness direction overlap each other, in a direction in which the protruding portion protrudes.

14. The flow path member according to claim 12, wherein the lid portion is located in a recessed portion formed in the second opposed surface, and is located closer to the bottom surface side of the recessed portion than the second opposed surface.

15. The flow path member according to claim 12, wherein the protruding portion includes a first protruding portion located on one side of both side edges of the groove portion, and a second protruding portion located on the other side thereof, and a width of the lid portion is longer than a distance between inner surfaces of the first and second protruding portions, and is shorter than a distance between outer surfaces of the first and second protruding portions.

16. A method for manufacturing a liquid ejection head comprising a liquid supply unit having a supply passage for liquid formed therein, and a liquid ejection unit capable of ejecting the liquid supplied through the supply passage from an ejection port, the liquid supply unit including first and second flow path forming members having first and second opposed surfaces opposed to each other, and a joining member which joins the first and second flow path forming members, the method comprising the steps of:

injection-molding the first flow path forming member having a groove portion forming the supply passage, and a protruding portion protruding from the first opposed surface to form a side wall of the groove portion, on the first opposed surface, at a first position between first and second molds, and injection-molding the second flow path forming member having a lid portion abutting against the protruding portion to cover the opening of the groove portion on the second opposed surface, at a second position between the first and second molds;

opening the first and second molds, while holding the first flow path forming member in the first mold and holding the second flow path forming member in the second mold;

relatively moving the first and second molds so that the protruding portion of the first flow path forming member and the lid portion of the second flow path forming member are made to face each other;

closing the first and second molds so that the protruding portion and the lid portion are made to abut against each other; and injection-molding the joining member which abuts against an outer surface of the protruding portion, the first opposed surface, and the second opposed surface.

* * * * *